United States Patent [19]

Bruey

[11] Patent Number: 4,823,100

[45] Date of Patent: Apr. 18, 1989

[54] DEFLECTION DISTORTION CORRECTION DEVICE

[75] Inventor: Paul M. Bruey, Bordentown, N.J.

[73] Assignee: RCA Licensing Corporation, Princeton, N.J.

[21] Appl. No.: 51,232

[22] Filed: May 14, 1987

Related U.S. Application Data

[63] Continuation of Ser. No. 760,793, Jul. 31, 1985, abandoned.

[51] Int. Cl.[4] ..... H01F 7/00

[52] U.S. Cl. ..... 335/210; 335/212; 313/421

[58] Field of Search ..... 335/210–212; 313/421, 431

[56] References Cited

U.S. PATENT DOCUMENTS

| | | | |
|---|---|---|---|
| 2,494,459 | 1/1950 | Torsch | 250/157 |
| 3,247,411 | 4/1966 | Kratz | 335/213 |
| 3,316,433 | 4/1967 | Reiches et al. | 335/212 |
| 3,725,831 | 4/1973 | Barbin | 335/212 |
| 3,913,042 | 10/1975 | Talsma | 335/210 |
| 4,143,345 | 3/1979 | Barkow | 335/212 |
| 4,257,023 | 3/1981 | Kamijo | 335/211 |
| 4,398,166 | 8/1983 | Bumgardner | 335/212 |
| 4,449,109 | 5/1984 | Paddock et al. | 335/212 |
| 4,451,807 | 5/1984 | McGlashan et al. | 335/211 |
| 4,490,703 | 12/1984 | Ruth | 335/210 |
| 4,511,871 | 4/1985 | Schier, Jr. et al. | 335/210 |
| 4,538,128 | 8/1985 | Fourché et al. | 335/212 |
| 4,668,929 | 5/1987 | Bernhard . | |

FOREIGN PATENT DOCUMENTS

| | | |
|---|---|---|
| 616353 | 1/1949 | United Kingdom . |
| 671331 | 4/1952 | United Kingdom . |
| 745718 | 2/1956 | United Kingdom . |
| 927025 | 5/1963 | United Kingdom . |
| 1077412 | 7/1967 | United Kingdom . |
| 1174589 | 12/1969 | United Kingdom . |
| 1513360 | 7/1978 | United Kingdom . |
| 2061160 | 5/1981 | United Kingdom . |

*Primary Examiner*—E. A. Goldberg
*Assistant Examiner*—Lincoln Donovan
*Attorney, Agent, or Firm*—Eugene M. Whitacre; Paul J. Rasmussen; Joseph J. Laks

[57] ABSTRACT

A deflection yoke field modifying device corrects N-S pincushion distortion without increasing A-zone convergence errors. The device may be of the form of a ferrite ring which is located near the electron beam exit end of the deflection yoke. The ring may be mounted on the yoke insulator. The ring shunts flux from the vertical deflection field in order to provide the desired N-S pincushion correction.

10 Claims, 3 Drawing Sheets

DEFLECTION DISTORTION CORRECTION DEVICE

This invention relates to raster distortion correction for cathode ray tubes used in video display apparatus.

Video display apparatus, such as television receivers and computer monitors, incorporate cathode ray tubes that display the video information on a phosphor display screen. One or more electron beams are scanned or deflected horizontally and vertically by electromagnetic fields generated by a deflection yoke in order to form a raster on the display screen. The difference in deflection distance between the edges and corners of the display screen causes, without correction, an inwardly bowed or pincushion shaped raster. With color video display apparatus the physical separation of the electron beams in the cathode ray tube electron gun assembly results in misconvergence or other beam landing errors on the display screen.

The horizontal and vertical deflection windings of the deflection yoke may be designed to provide substantial convergence and raster distortion correction by the particular winding distribution of the individual coils of the deflection windings. The winding distribution determines the overall harmonic content or nonuniformity of the deflection fields produced and also the localized variations in field nonuniformity along the longitudinal dimension of the deflection yoke.

Particular beam landing errors or raster distortions are more sensitive to correction as particular yoke longitudinal regions than at others and windings that produce localized variations in field nonuniformity can be effective in correcting many of these errors or distortions.

For example, a deflection yoke that provides substantial self-convergence of three in-line electron beams of a color cathode ray tube produces a horizontal deflection field having an overall pincushion-shaped field nonuniformity and a vertical deflection field having an overall barrel-shaped field nonuniformity. Localized variations in the field nonuniformities may then be made to correct specific errors or distortions while maintaining the overall nonuniformity necessary for self-convergence.

Mechanical winding constraints limit the amount of localized variation possible however, so that as a practical matter the possible winding distribution changes may cause undesirable interactive changes in errors and distortions. This may result in an inability to correct all errors and distortions fully, thereby requiring an undesirable compromise in the amount of correction provided.

The present invention provides an alternative to the previously described compromise conditions and allows more complete correction of particular raster distortion errors without aggravating or degrading other beam landing or beam convergence conditions.

In accordance with the present invention, a deflection yoke that deflects an electron beam in a cathode ray tube comprises horizontal and vertical deflection windings for producing horizontal and vertical deflection fields. A magnetically permeable member, forming a closed path, is disposed adjacent to the electron beam exit end of the yoke and modifies at least one of the horizontal and vertical deflection fields to correct deflection distortion introduced by the deflection fields.

In the accompanying drawing.

Figure 1:
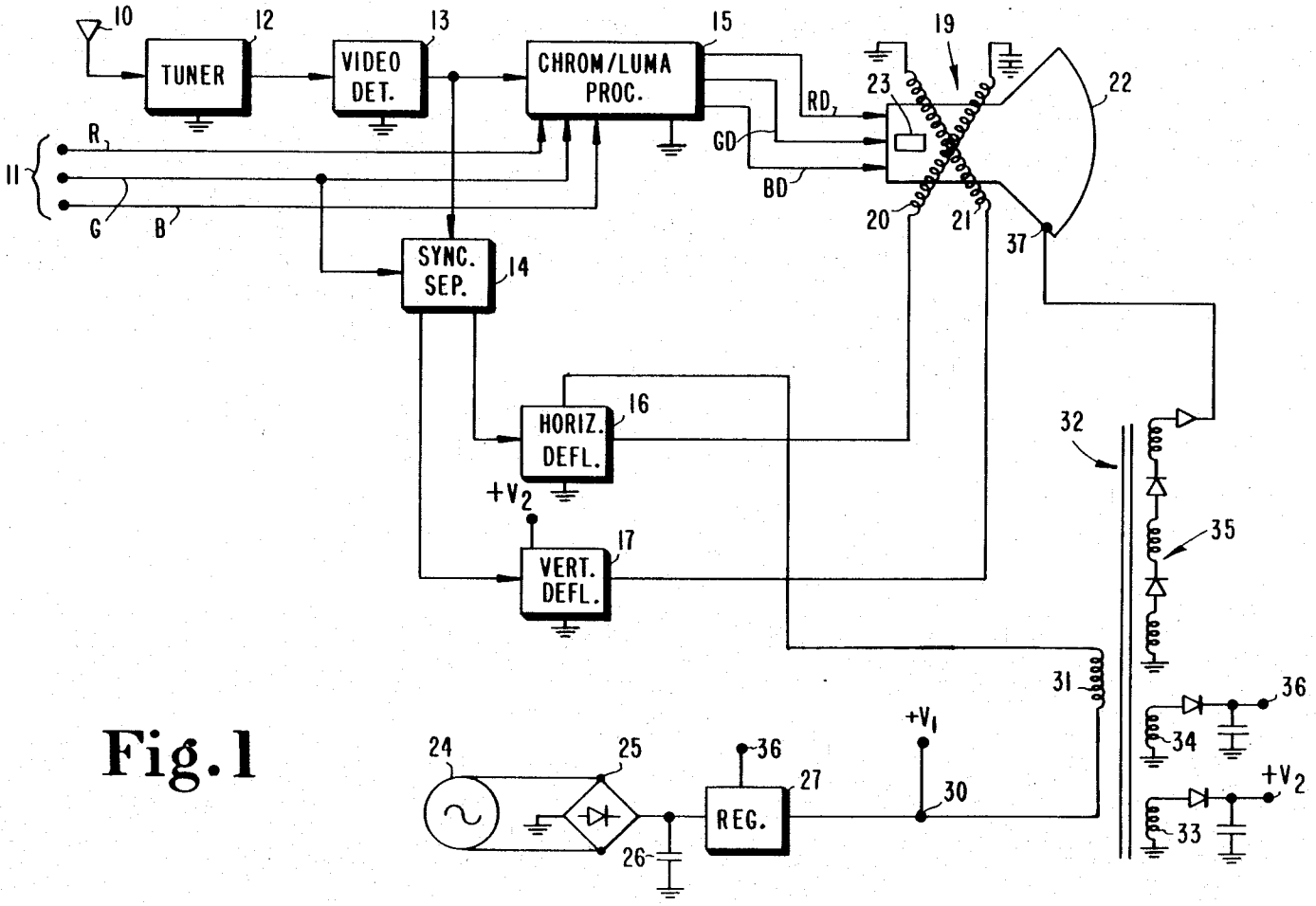
FIG. 1 is a schematic and block diagram of a video display apparatus deflection system including a deflection yoke constructed in accordance with the present invention.

Referring to FIG. 1, there is shown a portion of a video display apparatus that may operate as a television receiver and a computer monitor. The video display apparatus is responsive to broadcast signals received via an antenna 10, and to direct red, green and blue (RGB) video signals via input terminals 11. The broadcast signal is applied to tuner and intermediate frequency (IF) circuitry 12, whose output is applied to a video detector 13. The output of video detector 13 is a composite video signal that is applied to a synchronizing signal (sync) separator 14 and a chrominance and luminance signal processor 15. The sync separator 14 generates horizontal and vertical synchronizing pulses that are respectively applied to horizontal and vertical deflection circuits 16 and 17. Horizontal deflection circuit 16 produces a horizontal deflection current in a horizontal deflection winding 20 while vertical deflection circuit 17 produces a vertical deflection current in a vertical deflection winding 21. Horizontal and vertical deflection windings 20 and 21 comprise the deflection yoke 19 which is located on the neck of a cathode ray tube 22.

In addition to the composite video signal from video detector 13, chrominance and luminance signal processing circuit 15 may also receive individual red, green and blue video signal from a computer, for example, via terminals 11. Synchronizing pulses may be supplied to sync separator 14 via a separate conductor or, as shown in FIG. 1, associated illustratively with the green video signal. The output of chrominance and luminance processing circuitry 15 comprises the red, green and blue color drive signals, that are applied to the electron gun assembly 23 of cathode ray tube 22 via conductors RD, GD, BD, respectively. Electron gun assembly 23 may illustratively generate three horizontally aligned electron beams.

Power for the video display apparatus is supplied from a source of AC power 24, such as an AC line, which is coupled to a rectifying circuit 25 and a filter capacitor 26 to provide a source of unregulated DC voltage. The unregulated DC voltage is applied to a regulator 27, which may be of conventional design, such as a switch-mode regulator or an SCR regulator, that produces a regulated DC voltage level $+V_1$. The $+V_1$ supply may illustratively be used to power the horizontal deflection circuit 16.

The output of regulator 27 is also applied to a terminal 30 of a primary winding 31 of a power transformer 32. Winding 31 is coupled to horizontal deflection circuit 16. Energization of primary winding 31 energizes secondary windings 33 and 34, and high voltage winding 35. Winding 33 illustratively develops a voltage that is rectified and filtered to produce a $+V_2$ voltage that may be used to power various circuits of the video display apparatus, such as vertical deflection circuit 17. Winding 34 develops a voltage at a terminal 36 that may be used, for example, as a feedback voltage for regulator 27. High voltage winding 35 generates a high voltage level that is applied to the high voltage or ultor terminal 37 of cathode ray tube 22.

Deflection yoke 19 may be of a self-converging type which produces astigmatic deflection fields as required to accomplish convergence of the three in-line electron beams. An analysis using third order aberration theory indicates that substantial beam convergence is produced by a horizontal deflection field exhibiting an overall positive transverse nonuniformity, representing a pincushion-shaped field, and a vertical deflection field exhibiting an overall negative transverse nonuniformity, representing a barrel-shaped field.

Localized variations in field nonuniformity, while still maintaining the desired overall nonuniformity, are effective to correct certain raster distortions and beam landing errors. For example, E-W pincushion raster distortion, due to differences between the tube faceplate and the beam scanning radius, may be corrected by modifying the vertical deflection field to exhibit a pincushion nonuniformity near the electron beam exit end of the yoke. Such localized changes in field nonuniformity may be accomplished by changes in the winding distribution of the deflection coils. Correction of many or all distortion and errors, while still maintaining the desired overall field nonuniformity, may result in a yoke having coil winding distributions that are difficult or impossible to wind using known winding equipment and techniques. The physical limitations of modifying the coil winding distributions may also result in interaction between error and distortion conditions such that one type of error or distortion may be corrected while another is made worse. Often correction compromises must be made, resulting in a deflection yoke that may require additional distortion or error correction, for example, via circuitry of the video display apparatus.

The previously described correction compromise may be required in the case of an attempt to correct N-S pincushion distortion by modifying the horizontal deflection coils. This may degrade beam convergence at points midway between the center and corners of the cathode ray tube display screen, the so-called A-zone.

Figure 3:
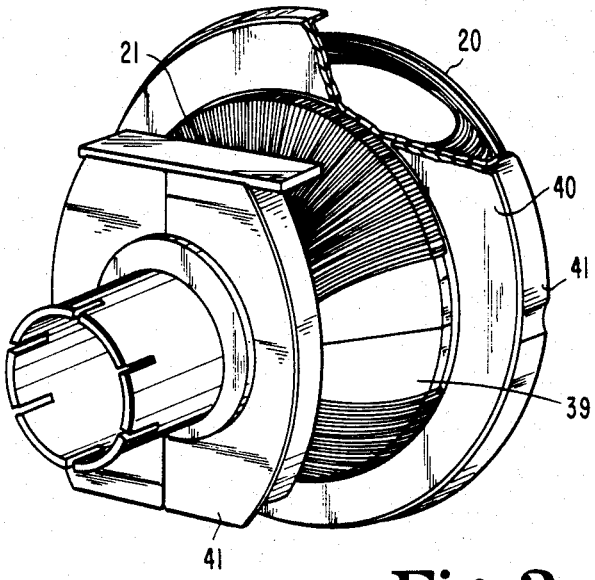
FIG. 3 is a perspective view of a deflection yoke, a portion of which is shown broken away, in accordance with an aspect of the present invention.
Figure 4:
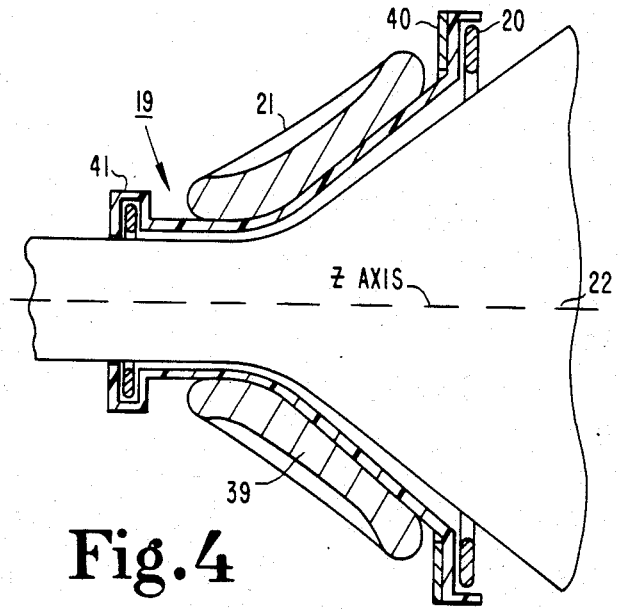
FIG. 4 is a side elevational cross-sectional view of a video display apparatus in accordance with the present invention.

FIG. 3 illustrates deflection yoke 19 in greater detail. Yoke 19 includes vertical deflection windings 21, toroidally wound on a magnetically permeable core 39. Horizontal deflection windings 20 are of a saddle-type and are separated from the vertical windings 21 by an insulator 41. FIG. 4 shows yoke 19 mounted on cathode ray tube 22 and shows the orientation of the windings 20 and 21.

Figure 2A:
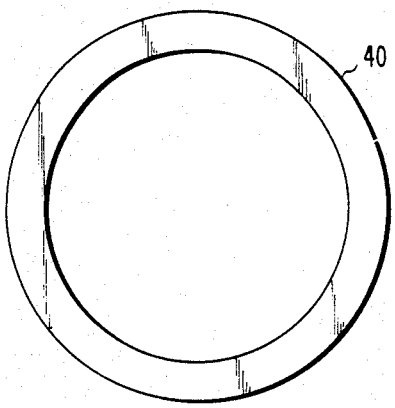
FIGS. 2A and 2B are front and side elevational views, respectively of a field modifying device in accordance with an aspect of the present invention.
Figure 2B:
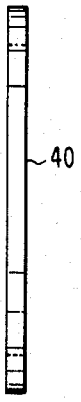

In accordance with an aspect of the present invention, a magnetically permeable device, shown in FIGS. 2A and 2B, is located on deflection yoke 19 near the electron beam exit end in order to provide substantial N-S pincushion distortion correction without degrading A-zone convergence. This device may be of the form of a thin torus or ring 40 made of a high magnetically permeable material, such as manganese or magnesium ferrite, that is positioned between the vertical deflection windings 21 and insulator 41 of deflection yoke 19, as shown in FIGS. 3 and 4. Ring 40 may be attached by glue or similar adhesive to the portion of insulator 41 that surrounds the end turns of horizontal deflection windings 20.

Ring 40 primarily operates by shunting a portion of the magnetic flux generated by current in vertical deflection windings 21 into ring 40, thereby changing the magnetic field intensity distribution along the electron beam deflection path. The change in magnetic field intensity will be greater near the ring than at regions away from the ring. Therefore, electron beams passing near the ring will experience a greater effect than electron beams near the ring center. Ring 40 may also modify the deflection field nonuniformity near the ring itself. Since the ring is thin, the longitudinal or z-axis region in which the ring is effective is small. Therefore, electron beams passing through the ring region at an oblique angle will travel a greater distance in the effective region and will therefore experience a greater influence by the ring than electrons that pass through the ring region substantially normal to the plane of the ring. Influence of the ring increases with increasing deflection since deflected beams will pass closer to the ring and traverse the ring region at an oblique angle with respect to undeflected beams. The influence of the ring also increases with increasing deflection angle of the cathode ray tube since the beams traverse the plane of the ring at an increasing oblique angle. It is possible therefore to control the amount of N-S pincushion distortion correction by changing the diameter and thickness of the ring, and the longitudinal location of the ring with respect to the electron gun assembly of the cathode ray tube.

Figure 5:
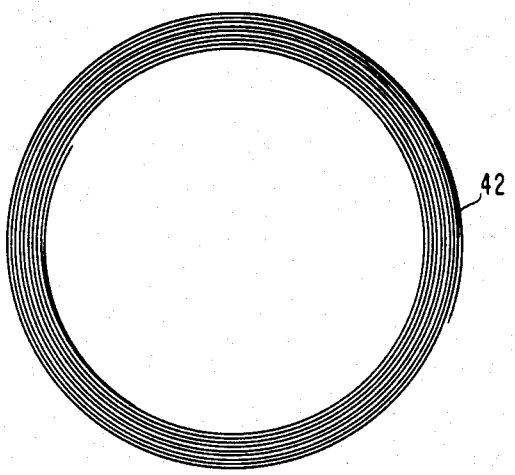
FIG. 5 is a front elevational view of an alternate embodiment of the field modifying device shown in FIG. 2.

FIG. 5 illustrates an alternate embodiment of the field modifying device of FIG. 3. A plurality of wire loops form a ring 42. As an illustrative example, 16 turns of #26 iron wire has been found to provide desirable N-S pincushion distortion correction. Ring 42 may be mounted to insulator 41 in a manner similar to that described with respect to ring 40; for example, by adhesive or some clamping arrangement.

What is claimed is:

1. A deflection arrangement including a deflection yoke for deflecting an electron beam of a cathode ray tube in a video display apparatus comprising:

horizontal and vertical deflection windings;

means for generating deflection current in said windings for producing horizontal and vertical deflection fields to deflect said electron beam in a raster pattern; and a magnetically permeable member forming a substantially closed path that encircles said electron beam and is disposed adjacent the electron beam exit end of said deflection yoke at a longitudinal location that enables said member to significantly modify the field pattern for the magnetic flux generated by deflection current flowing in at least one of said horizontal and vertical deflection windings to correct deflection raster pattern distortion.

2. The arrangement defined in claim 1, wherein said magnetically permeable member comprises a ferrite ring.

3. The arrangement defined in claim 1, wherein said magnetically permeable member comprises a plurality of concentric wire loops forming a coil.

4. The arrangement defined in claim 1, wherein said magnetically permeable member shunts a portion of the flux produced by said vertical deflection winding.

5. A deflection yoke for deflecting an electron beam of a cathode ray tube in a video display apparatus comprising:

horizontal and vertical deflection windings for producing horizontal and vertical deflection fields, respectively when energized; and a magnetically permeable member, forming a substantially closed path that encircles said electron beam and is disposed adjacent the electron beam exit end of said deflection yoke, said member modifying at least one of said horizontal and vertical deflection fields produced by said horizontal and vertical deflection windings, to correct deflection distortion, wherein said horizontal deflection winding comprises a saddle type winding having flux return end turns located at said electron beam exit end of said yoke, said magnetically permeable member disposed between said flux return end turns and said vertical deflection winding.

6. The arrangement defined in claim 1, wherein said magnetically permeable member primarily modifies said vertical deflection field.

7. The arrangement defined in claim 1, wherein said deflection distortion comprises N-S pincushion distortion.

8. A deflection yoke for deflecting an electron beam of a cathode ray tube in a video display apparatus comprising:

horizontal and vertical deflection windings for producing horizontal and vertical deflection fields respectively, that are generated by current flowing therein; and a thin torus-like member encircling said electron beam and disposed adjacent the electron beam exit end of said deflection yoke at a longitudinal location that enables said member to significantly modify the field pattern for the magnetic flux generated by current in at least one of said horizontal and vertical deflection windings to correct deflection raster pattern distortion, the modification of said magnetic flux by said member substantially limited to and occurring within the plane of said torus-like member.

9. A video display apparatus comprising:

a cathode ray tube for producing an electron beam;

a deflection yoke incorporating horizontal and vertical deflection windings;

means for generating deflection current in said windings for producing horizontal and vertical deflection fields to deflect said electron beam in a raster pattern; and mean for correcting N-S pincushion distortion on the display screen of said cathode ray tube comprising:

a magnetically permeable member encircling said electron beam and disposed at the electron beam exit end of said deflection yoke at a longitudinal location that enables said member to reduce the intensity of said vertical deflection field produced by said vertical deflection winding in the immediate region of said magnetically permeable member in a manner that provides correction of said N-S pincushion distortion.

10. A video display apparatus comprising:

a cathode ray tube incorporating a display screen and means for producing an electron beam for illuminating said display screen;

a deflection yoke with current flowing therein for producing horizontal and vertical deflection fields for deflecting said electron beam; and means for modifying at least one of said horizontal and vertical deflection fields produced by said deflection yoke in order to correct raster pattern distortion associated with deflection of said electron beam, comprising a magnetically permeable member substantially without magnetization encircling said electron beam in a closed loop path and disposed at the electron beam exit end of said deflection yoke and constructed in a plane generally perpendicular to the longitudinal axis of said deflection yoke at a longitudinal location that permits the shunting of a portion of the magnetic flux generated by said current in said deflection yoke occurring in said plane of said permeable member away from said electron beam in order to reduce the effect of said one deflection field on said electron beam.

* * * * *